US005271905A

United States Patent [19]

Owen et al.

[11] Patent Number: 5,271,905

[45] Date of Patent: * Dec. 21, 1993

[54] APPARATUS FOR MULTI-STAGE FAST FLUIDIZED BED REGENERATION OF CATALYST

[75] Inventors: Hartley Owen, Belle Mead, N.J.; Paul H. Schipper, Wilmington, Del.

[73] Assignee: Mobil Oil Corporation, Fairfax, Va.

[ * ] Notice: The portion of the term of this patent subsequent to Jul. 7, 2009 has been disclaimed.

[21] Appl. No.: 925,840

[22] Filed: Aug. 7, 1992

Related U.S. Application Data

[62] Division of Ser. No. 515,942, Apr. 26, 1990, Pat. No. 5,139,649.

[51] Int. Cl.[5] ..... B01J 8/26; B01J 8/28; F27B 15/08; F27B 15/16

[52] U.S. Cl. ..... 422/142; 208/153; 422/143; 422/144; 422/145; 422/146; 422/147

[58] Field of Search ..... 422/142, 144, 145, 146, 422/147; 208/119, 113, 120, 150, 152, 153; 502/41, 55

[56] References Cited

U.S. PATENT DOCUMENTS 3,563,911 2/1971 Pfeiffer et al. ..... 422/144 X
5,128,108 7/1992 Owen et al. ..... 422/141 X
5,139,649 8/1992 Owen et al. ..... 208/113

*Primary Examiner*—Robert J. Warden
*Assistant Examiner*—Amalia L. Santiago
*Attorney, Agent, or Firm*—Alexander J. McKillop; Malcolm D. Keen; Richard D. Stone

[57] ABSTRACT

A process and apparatus for achieving turbulent or fast fluidized bed regeneration of spent FCC catalyst in a bubbling bed regenerator having a stripper mounted over the regenerator and a stripped catalyst standpipe within the regenerator. A coke combustor vessel, which may be partially or totally open to the dilute phase above the bubbling bed, is added to the existing regenerator vessel Spent catalyst is discharged into the coke combustor, regenerated in a turbulent or fast fluidized bed, then discharged into the dilute phase region above the bubbling bed, either via a deflector or by simply overflowing the combustor. Regeneration of catalyst is completed in the bubbling dense bed, and/or an annular fast fluidized bed surrounding the coke combustor. Catalyst may be recycled from the dense bed to the coke combustor either by a flow line, or by adjusting relative heights of bubbling to fast fluidized bed. Staged regeneration increases coke burning capacity of the regenerator, reduces NOx emissions, and reduces catalyst deactivation.

7 Claims, 3 Drawing Sheets

APPARATUS FOR MULTI-STAGE FAST FLUIDIZED BED REGENERATION OF CATALYST

This is a division of copending application Ser. No. 07/515,942, filed on Apr. 26, 1990, now U.S. Pat. No. 5,139,649.

BACKGROUND OF THE INVENTION

1. Field of the Invention

The invention relates to a process and apparatus for the regeneration of fluidized catalytic cracking catalyst.

2. Description of Related Art

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.-600° C., usually 460° C.-560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.-900° C., usually 600° C.-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking has undergone progressive development since the 40s. The trend of development of the fluid catalytic cracking (FCC) process has been to all riser cracking and use or zeolite catalysts. A good overview of the importance of the FCC process, and its continuous advancement, is reported in Fluid Catalytic Cracking Report, Amos A. Avidan, Michael Edwards and Hartley Owen, as reported in the Jan. 8, 1990 edition of the Oil & Gas Journal.

Modern catalytic cracking units use active zeolite catalyst to crack the heavy hydrocarbon feed to lighter, more valuable products. Instead of dense bed cracking, with a hydrocarbon residence time of 20-60 seconds, much less contact time is needed. The desired conversion of feed can now be achieved in much less time, and more selectively, in a dilute phase, riser reactor.

Although reactor residence time has continued to decrease, the height of the reactors has not. Although the overall size and height of much of the hardware associated with the FCC unit has decreased, the use of all riser reactors has resulted in catalyst and cracked product being discharged from the riser reactor at a fairly high elevation. This elevation makes it easy for a designer to transport spent catalyst from the riser outlet to a catalyst stripper at a lower elevation, to a regenerator at a still lower elevation.

The need for a somewhat vertical design, to accommodate the great height of the riser reactor, and the need to have a unit which is compact, efficient, and has a small "footprint", has caused considerable evolution in the design of FCC units, which evolution is reported to a limited extent in the Jan. 8, 1990 Oil & Gas Journal article. One modern, compact FCC design is the Kellogg Ultra Orthoflow converter, Model F, which is shown in FIG. 1 of this patent application, and also shown as FIG. 17 of the Jan. 8, 1990 Oil & Gas Journal article discussed above. The compact nature of the design, and the use of a catalyst stripper which is contiguous with and supported by the catalyst regenerator, makes it difficult to expand or modify such units. This means that the large, bubbling dense bed regenerator is relatively difficult to modify, in that it is not easy to increase height much. As the regenerator vessel usually is at or near grade level, it is difficult to do more than minor modifications under the regenerator.

Although such a unit works well in practice, the use of a bubbling bed regenerator is inherently inefficient, and troubled by the presence of large bubbles, poor catalyst circulation, and the presence of stagnant regions. The bubbling bed regenerators usually have much larger catalyst inventories, and longer catalyst residence times, to allow an increase in residence time to make up for a lack of efficiency.

For such units, characterized by a stripper mounted over, and partially supported by, a bubbling dense bed regenerator, there has been no good way to achieve the benefits of high efficiency regeneration, in a fast fluidized bed (FFB) region.

We studied this design, and realized that there was a way to achieve the benefits of FFB coke combustion, while retaining most of the original design. We were even able to obtain some improvements, which made our modified design more efficient, in some ways, than either the original dense bed design or a more modern high efficiency regenerator design (H.E.R.).

BRIEF SUMMARY OF THE INVENTION

Accordingly, the present invention provides a process for the fluidized catalytic cracking of a heavy feed to lighter more valuable products by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, spent catalyst is discharged from said disengaging zone into a catalyst stripper contiguous with and beneath said disengaging zone and wherein said spent catalyst is contacted with a stripping gas to produce stripped catalyst, and said stripped catalyst is collected in a vertical standpipe beneath the stripping zone and then discharged from said standpipe into a catalyst regeneration zone contiguous with and beneath said stripping zone, and said regeneration zone comprises a single dense phase bubbling fluidized bed of catalyst to which an oxygen containing regeneration gas is added and from which hot regenerated catalyst is withdrawn and recycled to said riser reactor, characterized by multi-stage regeneration of said catalyst by: discharging said stripped catalyst from said catalyst standpipe into a vertical, generally cylindrical coke combustor vessel which is at least partially immersed in said bubbling dense bed; adding an oxygen containing regeneration gas to said coke combustor vessel in an amount sufficient to provide a superficial vapor velocity which will maintain a majority of the catalyst therein as a turbulent or fast fluid bed; discharging partially regenerated catalyst and flue gas from said coke combustor into said dilute phase region within said regenerator vessel containing said bubbling fluidized bed; and collecting said partially regenerated catalyst in said bubbling fluidized bed; adding additional oxygen containing gas to said bubbling fluidized bed in an amount sufficient to maintain said bed as a bubbling, dense phase fluidized bed, and sufficient to complete the regeneration of the catalyst.

In an apparatus embodiment, the present invention provides an apparatus for the fluidized catalytic cracking of a heavy feed to lighter more valuable products by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, spent catalyst is discharged from said disengaging zone into a catalyst stripper contiguous with and beneath said disengaging zone and wherein said spent catalyst is contacted with a stripping gas to produce stripped catalyst, and said stripped catalyst is collected in a vertical standpipe beneath the stripping zone and then discharged from said standpipe into a catalyst regeneration zone contiguous with and beneath said stripping zone, and said regeneration zone comprises a single dense phase bubbling fluidized bed of catalyst to which an oxygen containing regeneration gas is added and from which hot regenerated catalyst is withdrawn and recycled to said riser reactor, said regeneration zone characterized by: a stripper catalyst standpipe within said regeneration zone having a stripped catalyst inlet connective with said catalyst stripper and an outlet; a coke combustor vessel which is at least partially immersed in said bubbling dense bed, said coke combustor vessel having a stripped catalyst inlet in a lower portion thereof connective with said stripper standpipe catalyst outlet, a combustion air inlet in a lower portion thereof, and an outlet in an upper portion thereof connective with the dilute phase region within said regeneration zone and adapted to discharge catalyst and flue gas from said coke combustor directly into said dilute phase region.

In preferred embodiments, the present invention also provides a process and apparatus for achieving multi stage regeneration, in an additional fast fluidized bed region, preferably disposed as an outer annular section within the existing regenerator vessel.

DESCRIPTION OF PREFERRED EMBODIMENTS

Figure 1:
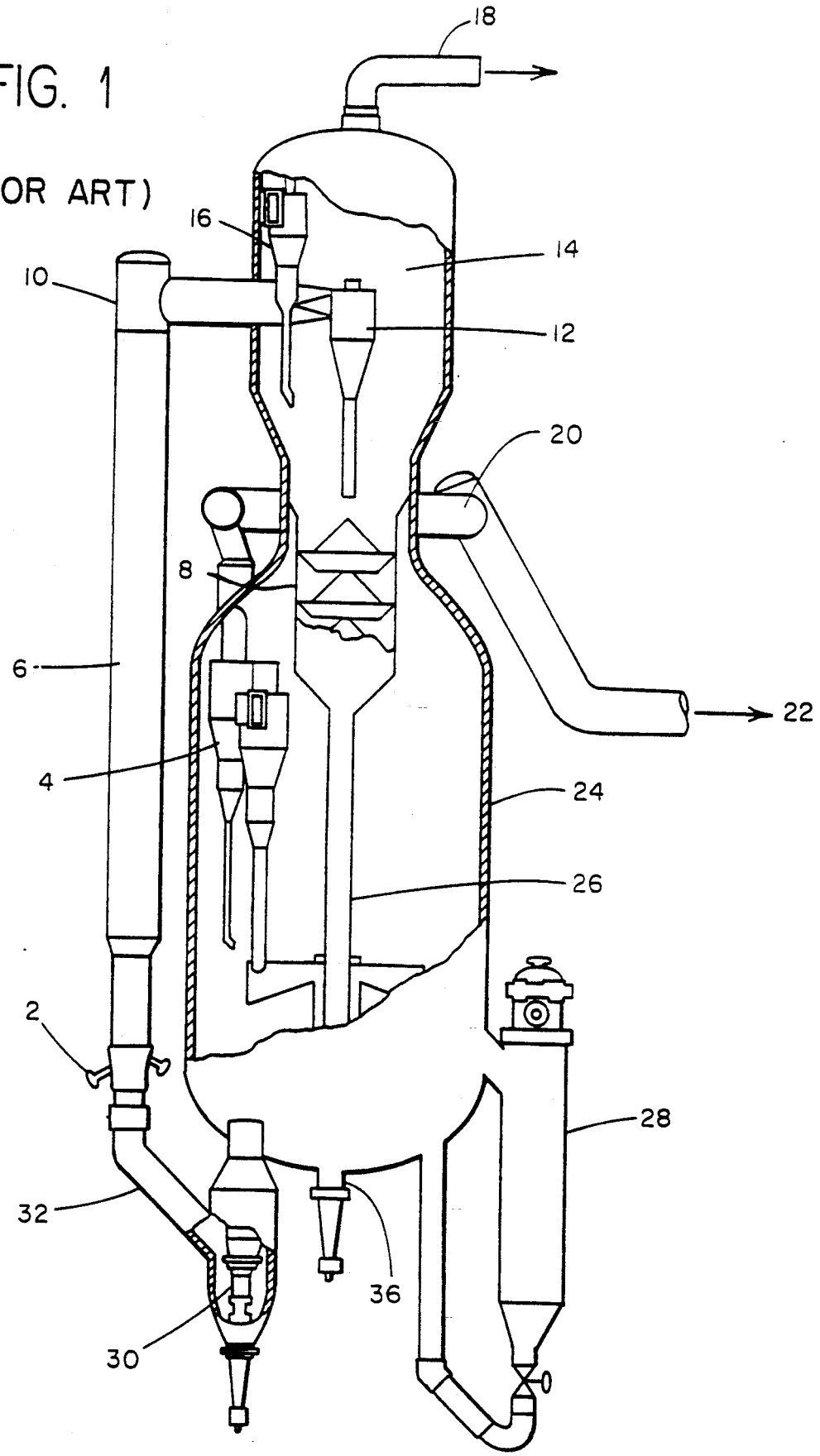
FIG. 1 (PRIOR ART)
FIG. 1 (prior art) is a schematic view of a conventional fluidized catalytic cracking unit.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from a dipleg of riser cyclones 12 into catalyst stripper 8, where one, or preferably 2 or more, stages of steam stripping occur, with stripping steam admitted by means not shown in the figure. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. Flue gas, and some entrained catalyst, are discharged into a dilute phase region in the upper portion of regenerator 24. Entrained catalyst is separated from flue gas in multiple stages of cyclones 4, and discharged via outlets 8 into plenum 20 for discharge to the flare via line 22. A catalyst cooler 28 is provided so that heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed.

Figure 2:
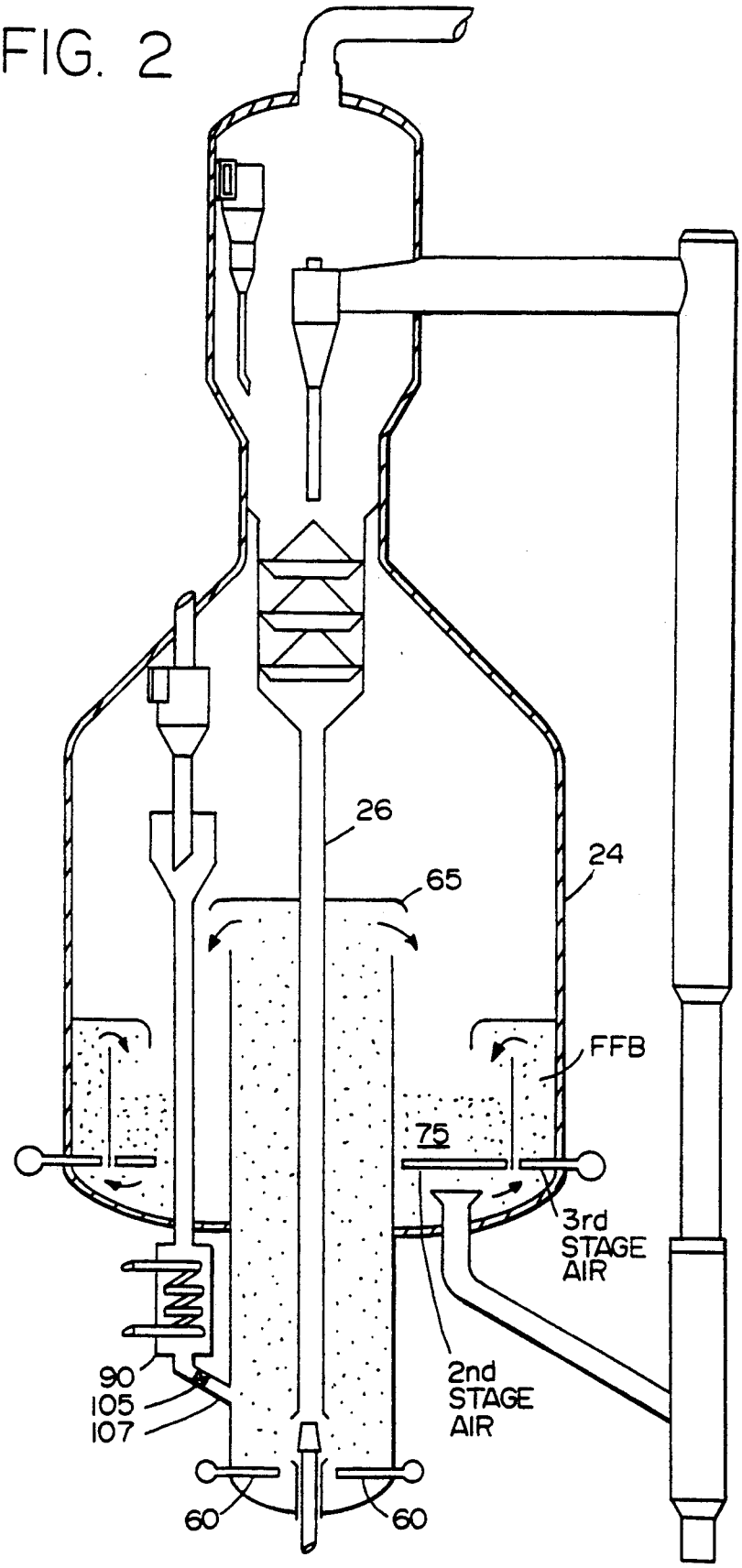
FIG. 2 (invention) is a schematic view of a regenerator of the invention, with a bubble capped FFB region in the base of the regenerator.

In FIG. 2 (invention) only the changes made t the old regenerator shell 24 are shown. Like elements in FIG. 1 and 2 have like numerals.

A high efficiency, coke combusting pod 50 is added to the base of, or passes through, the base of the old regenerator vessel 24. Stripped catalyst from the catalyst stripper is discharged via stripper dipleg 26 down into the coke combustor 50. The catalyst is discharged into a relatively dense bed, fast fluidized bed (FFB) region 55, where incoming spent catalyst contacts regeneration gas, usually air, added via multiple inlets 60. Although only a single level of air admission is shown, it is possible to add air at many places in the design, ranging from the very bottom of the FFB region to upper levels of the FFB.

In pod 50 the air admission rate, and the cross-sectional area available for flow, and catalyst addition and catalyst recycle, if any, are adjusted to maintain much or all of the bed in at least a turbulent fluidized condition, and preferably in a "fast fluidized condition", characterized by intense agitation, relatively small bubbles, and rapid coke combustion. In terms of superficial vapor velocity and typical FCC catalyst sizes, this means the vapor velocity should exceed 3.5 feet per second, preferably is 4–15 feet per second, and most preferably is 4–10 feet per second. The catalyst density in a majority of the volume in the coke combustor will be less than 35 pounds/cubic foot, and preferably less than 30 pounds/cubic foot, and ideally about 25 pounds/cubic foot.

The densities and superficial vapor velocities discussed herein presume that the unit operates at a pressure where the vast majority of FCC units operate, namely 25–40 psig. A few might operate at slightly lower pressures, and a significant minority may operate at somewhat higher pressures, primarily those with power recovery systems. Changes in pressure change the superficial vapor velocity needed to maintain, e.g., a fast fluidized bed or a bubbling dense bed. It is easy to calculate the superficial vapor velocity needed to support a given type of fluidization, and the bed density expected at those conditions. In general, an increase in pressure will decrease the superficial vapor velocity needed to achieve a fast fluidized bed.

The partially regenerated catalyst, and partially consumed combustion gas are discharged from the pod 50 via a "bubble cap" 65 which isolates the pod 50 to some extent from the rest of the regenerator vessel. The bubble cap 65 deflects downwardly a mixture of partially regenerated catalyst and flue gas into the much larger volume inside vessel 24. The rapid increase in volume, or in cross sectional area available for fluid flow, results in a rough but rapid separation of catalyst from flue gas. A majority, preferably over 90% of the catalyst is discharged downwardly in a relatively compact mass toward the dense bed of catalyst 75 in the base of the existing regenerator shell 24. Air is added to bed 75 via air ring 160 to maintain fluidization and preferably to achieve a significant amount of coke combustion. Although bed 75 is a typical fluidized bubbling bed, characterized by relatively large stagnant regions, and large bubbles of combustion air which bypass the bed, it is an excellent place to achieve some additional coke combustion. One of the most significant benefits of coke combustion in bubbling bed 75 is the relatively drier atmosphere. There is a lower steam partial pressure in the dense bed 75 of the present invention than in a conventional dense bed regenerator, such as that shown in FIG. 1. Much of the reduction in steam partial pressure is due to the removal of water of combustion, and entrained stripping steam, with the flue gas discharged from the coke combustor. By using a flue gas/catalyst separation means such as cap 65 on the transport riser outlet, the relatively high steam content flue gas is separated from the catalyst which is discharged down to form the bubbling fluidized bed 75. It is also possible to greatly reduce the load on the cyclones 100 above the bubbling dense bed, because much less combustion air, and consequently less entrainment of catalyst into the dilute phase, is needed when only a fraction of the coke combustion occurs in the bubbling dense bed. Even without a separation means such as cap 65, the dense bed region 75 of the present invention will be drier than the dense bed of the regenerator of FIG. 1 (prior art).

In the preferred embodiment shown, an additional stage of combustion in annular region 155 defined by baffle 145 and the walls of regenerator vessel 24. Catalyst from dense bed region 75 flows under baffle 145, contacts additional combustion air added via air ring 260, or other equivalent means, and flows up into a third combustion stage 155. Preferably enough air is added, relative to the cross sectional area, to result in superficial vapor velocities which produce a turbulent fluid bed or more preferably a fast fluidized bed. In this way additional coke combustion, and afterburning of CO to $CO_2$ can be achieved in an efficiently fluidized bed, which is extremely dry. The coke on catalyst will have a very low hydrogen content, because all of the "fast coke" will have been burned in the coke combustor, and a majority of the hydrogen content of the remaining coke will be eliminated in the dense bed 75. Coke combustion in the third stage region 155 will be free of the two major sources of steam in FCC regenerators, namely water of combustion and entrained stripping steam. Thoroughly regenerated catalyst is discharged from the top of region 155 via radial deflector 165, which functions much like bubble cap 65 in that a significant separation of catalyst from flue gas is achieved.

Preferably from 20 to 90% of the coke combustion occurs in the coke combustor and dilute phase transport riser. Another 5 to 50% of the coke combustion occurs in the bubbling bed 75, and most preferably from 10 to 40%. Another 5 to 50% of the coke combustion occurs in the third stage combustion zone 155, and most preferably from 10 to 40%.

In many units the optimum amount of coke combustion that occurs in each zone will depend on quite a few factors, the amount of sulfur and nitrogen in the feed, rate of catalyst replacement, metals contamination in the feed, etc. For cleanest catalyst, when metals and NOx emissions are not a problem, it is beneficial to front load the air addition, i.e., to maximized coke combustion in bed 55. To minimize NOx, coke combustion should be delayed, so that large amounts of carbon will be present to hinder NOx formation.

It is possible, by means not shown in the Figure, to divert catalyst discharged from the third stage region to a catalyst "bathtub" supplying hot regenerated catalyst for recycle to the reactor via line 32. This minimized backmixing of catalyst from the third stage region 155 with catalyst in the bubbling dense bed region 75.

It will be frequently be beneficial to recycle some hot regenerated catalyst to the fast fluidized bed region in vessel 50. Such recycle can come from the dense bed 75, or preferably, from a primary cyclone such as cyclone 100, as shown in the drawing. Hot catalyst is discharged down dipleg 102 into a catalyst return funnel 104, which can be much higher than the top of the bubbling dense bed 75. Accordingly, a large head will be available to permit controlled transfer of hot regenerate catalyst from the cyclone dipleg to the fast fluidized bed region, with flow control achieved via slide valve 105. Regenerated catalyst is then charged to the FFB region via line 107.

A catalyst cooler 90 may be provided to permit an efficient way to remove some heat from the regenerator, if heavy crudes or unusual operating conditions prevent a classical heat balanced operation. Catalyst coolers can also be associated with the dense bed 75, the FFB region 55, or on the return line to the reactor, line 32.

Figure 3:
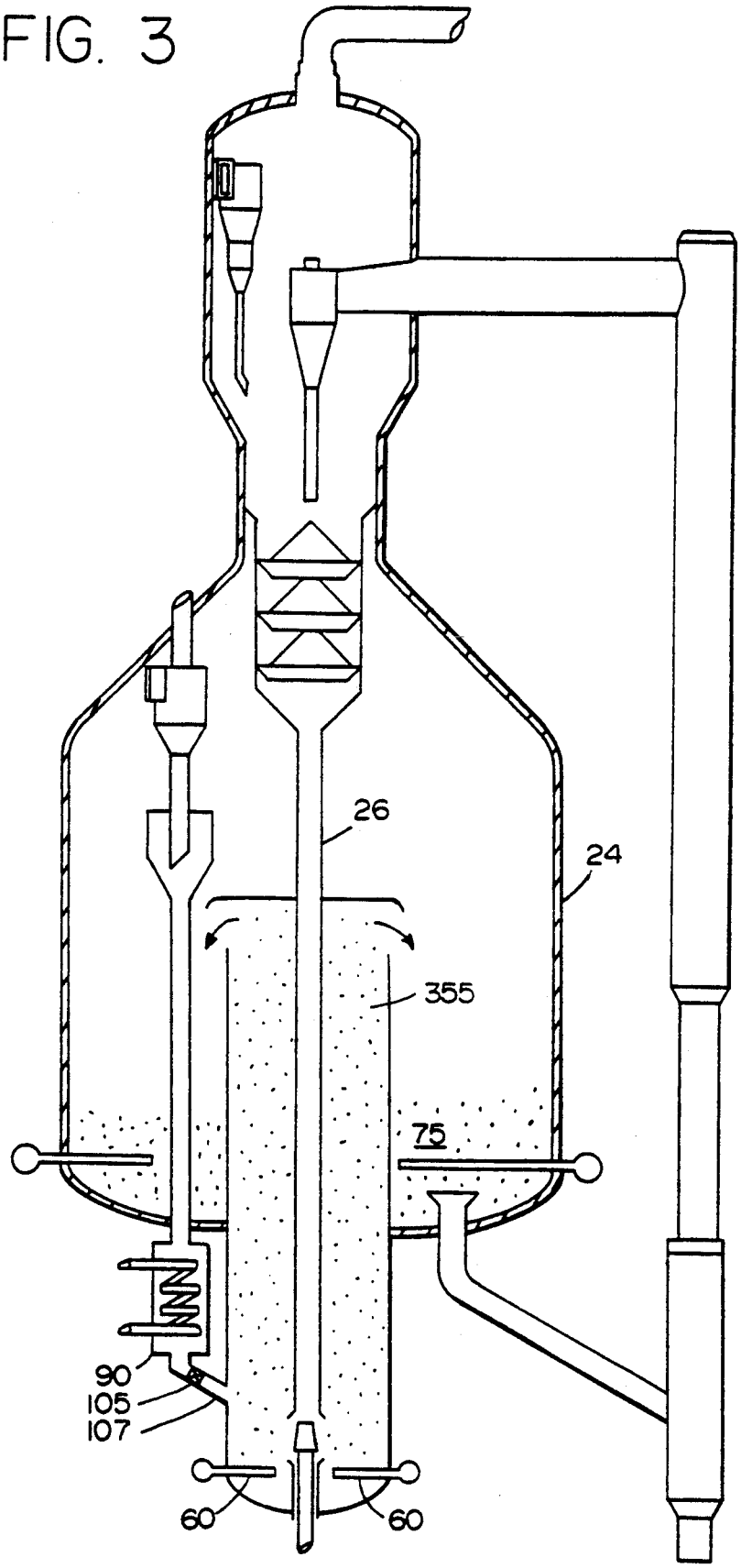
FIG. 3 is a schematic view of another embodiment of the invention, showing an open FFB region in the base of the regenerator.

FIG. 3 shows another embodiment of the invention, with an open or unsealed coke combustor 350 created in the bubbling fluidized bed region 75. Mechanically, this is the easiest way to achieve the benefits of fast fluidized bed coke combustion, at minimum capital cost. The FIG. 3 embodiment even allows a significant amount of catalyst recycle, i.e., recycle of hot regenerated catalyst from the bubbling dense bed to the coke combustor, without a catalyst recirculation line or any valve. Catalyst recycle can be achieved by regulating the relative depths of the dense bed 75 to the sidewalls of the coke combustor 350. Operation with a relatively high dense bed 75 level will result in considerable circulation of hot regenerated catalyst into coke combustor 350. Lowering of the dense bed 75 level, as by reducing the superficial vapor velocity in the bed, or operating with a lower catalyst inventory, will reduce the tendency of hot regenerated catalyst from bed 75 to overflow into, or splash or migrate into, the coke combustor 350. The FIG. 3 approach will achieve a relatively drier regeneration in bed 75, because any steam discharged from the coke combustor will tend to travel up.

The coke combustor of the present invention can benefit significantly from indirect heat exchange, i.e., the transfer of heat from the bubbling dense be 75 into coke combustor 350. Use of relatively conductive, rather than insulating, refractory linings, heat pipes, fins, dimples, and the like can be used to increase indirect heat exchange from bed 75 into the coke combustor. Indirect heat exchange is highly beneficial in reducing catalyst traffic in the coke combustor, and hence catalyst carryover into the dilute phase region, and in reducing exposure of regenerated catalyst to the relatively high steam partial pressures which occur in the coke combustor due to water of combustion.

A drawback to the approach shown in FIG. 3 is that there can be some increase in catalyst traffic in the dilute phase region above bubbling dense bed 75, especially when a large amount of coke combustion occurs in this region This can be tolerated in many units, because the amount of combustion air needed, and the resulting superficial vapor velocity, in bubbling bed 75 can be greatly reduced or eliminated. There will be a large increase in catalyst traffic near the outlet 355 of coke combusting pod 350, but this will be partially or totally offset by a great reduction in catalyst traffic above bubbling bed 75. Where desired, improved cyclones, precipitators, or other conventional means may be added to permit more catalyst entrainment in the dilute phase above bubbling dense bed 75.

The coke burning capacity of the regenerators of the invention can be greatly increased by doing most of the coke burning in the FFB region of the pod, while still achieving a significant amount of coke burning in the bubbling dense bed 75. It will of course be necessary to make a number of modifications to the unit, e.g., provision for adding combustion air not only to the FFB region (pod 50 in FIG. 2, pod 350 in FIG. 3), but also to the bubbling dense bed region 75.

It may be beneficial to provide for several different ways in which heat can be removed from around the regenerator, e.g., catalyst is removed from the dense bed, or a cyclone dipleg (FIG. 2), heat is removed from the catalyst, and the catalyst is returned to the dense bed. A catalyst cooler may also be provided on the regenerated catalyst return line to the riser reactor, to permit increasing cat:oil ratios in the unit. A "thimble" cooler, i.e., a vessel connected with and open to some portion of the regenerator may also be used. In this device catalyst flows from a dense bed into the thimble by fluid dynamics, and is displaced from the thimble back into the dense bed by the action of a fluidizing gas. The thimble operates without catalyst supply or return lines, and does not require a slide valve to control catalyst flow, catalyst flow and heat exchange are controlled by the amount of fluidizing gas added to the base of the thimble.

DESCRIPTION OF PREFERRED EMBODIMENTS

FCC Feed

Any conventional FCC feed can be used. The process of the present invention is especially useful for processing difficult charge stocks, those with high levels of CCR material, exceeding 2, 3, 5 and even 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids, and mixtures thereof. The present invention is most useful with feeds having an initial boiling point above about 650° F.

The most uplift in value of the feed will occur when a significant portion of the feed has a boiling point above about 1000° F., or is considered non-distillable, and when one or more heat removal means are provided in the regenerator, as shown in FIG. 1 or in FIG. 3.

FCC Catalyst

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles, or mixed in with each particle of the cracking catalyst Additive can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Good additives for removal of SOx are available from several catalyst suppliers, such as Davison's "R" or Katalistiks International, Inc.'s "DeSox."

CO combustion additives are available from most FCC catalyst vendors.

The FCC catalyst composition, per se, forms no part of the present invention.

Cracking Reactor/Stripper/Regenerator

The FCC reactor, stripper and regenerator shell 24, per se, are conventional, and are available from the M.W. Kellogg Company.

The modifications needed to add the combustor pod, or FFB region within, or built partially into, the base of the existing regenerator shell 24, and the optional radial FFB region shown in FIG. 2 are well within the skill of the art.

Regenerator Process Conditions

Conditions in the combustor pod, or FFB region are very similar to those used in the fast fluidized bed regions of conventional High Efficiency Regenerators (HER) now widely used in FCC units. Typical H.E.R. regenerators are shown in U.S. Pat. Nos. 4,595,567 (Hedrick), 4,822,761 (Walters, Busch and Zandona) and 4,820,404 (Owen), which are incorporated herein by reference.

Immersion of the coke combustor within the bubbling dense bed permits a reduction or elimination of catalyst recycle to the dense bed.

These conditions are conventional, what is unconventional is achieving fast fluidized bed catalyst regeneration in a bubbling bed regenerator with a superimposed catalyst stripper discharging spent catalyst down directly into the regenerator via a standpipe within the dense bed regeneration vessel.

It is preferred to add enough combustion air to the combustor pod to remove 20 to 95% of the coke, more preferably from 50 to 90% of the coke.

It is preferred to add enough combustion air to the bubbling dense bed, and the optional radial FFB region, to remove the remainder of the coke necessary to produce regenerated catalyst with the desired coke level, typically less than 0.1 wt. %, and preferably less than 0.05 wt %, or less.

Benefits of Staged Combustion

The process of the present invention achieves several important objectives in the shell of an existing regenerator. Among the objectives are increased coke burning capacity, reduced NOx emissions, and reduced catalyst deactivation. Each will be briefly reviewed.

Increased coke burning capacity can be achieved because each square foot of the old bubbling bed regenerator can be used as productively as before, while the FFB region(s) burns two to three times as much coke per square foot of cross sectional area as compared to a bubbling bed regenerator. In the embodiment shown in FIG. 2, with some separation of catalyst from flue gas discharged from the coke combustor, there will be a net reduction in catalyst traffic in the dilute phase. Even with coke combustion in the bubbling dense bed the air rate will be less, to the extent that catalyst is decoked in the coke combustor, and this reduced air rate the bubbling dense bed will reduce catalyst entrainment from the dense bed into the dilute phase region.

Reduced NOx emissions can be achieved because most of nitrogen compounds are burned under relatively mild, perhaps even partially reducing conditions in the FFB region in the coke combustor. The presence of a reducing atmosphere, and the presence of carbon, both of which occur more in this FFB region than anywhere else in the regenerator, tend to suppress formation of NOx, so that large amounts of coke combustion can be achieved without inordinate amounts of NOx being formed.

Improved catalyst stability is obtained by steaming the catalyst less. More than 90% of the "fast coke" or hydrogen rich coke is removed in the coke combustor pod, under fast fluidized bed regeneration conditions. The complete regeneration of the catalyst, and removal of the "hard coke", and the highest temperatures, and the most oxidizing conditions, can be left to the bubbling fluidized bed and/or the radial FFB region. This staged combustion allows most of the water of combustion to be formed and rapidly removed, in the flue gas from the coke combustor, allowing drier regeneration of catalyst in the downstream regions, e.g., the bubbling dense bed. The hydrogen rich coke is largely eliminated in the coke combusting pod, so there will be significantly less water of combustion formed in the bubbling dense bed. There will still be some catalyst deactivation, thermal deactivation in the bubbling dense bed and some hydrothermal deactivation as catalyst from the bubbling dense bed is entrained or carried into the dilute phase region of the regenerator. The dilute phase region above the coke combustor and the second dense bed is not partitioned, so water of combustion formed in the coke combustor will increase the steam partial pressure in the dilute phase region above the dense bed. The present invention will not eliminate catalyst deactivation in the regenerator, just reduce it significantly.

CO Combustion Promoter

Use of a CO combustion promoter in the regenerator or combustion zone is not essential for the practice of the present invention, however, it is preferred These materials are well-known.

U.S. Pat. Nos. 4,072,600 and 4,235,754, which are incorporated by reference, disclose operation of an FCC regenerator with minute quantities of a CO combustion promoter From 0.01 to 100 ppm Pt metal or enough other metal to give the same CO oxidation, may be used with good results. Very good results are obtained with as little as 0.1 to 10 wt. ppm platinum present on the catalyst in the unit.

FCC Reactor Conditions

Conventional riser cracking conditions may be used. Typical riser cracking reaction conditions include catalyst/oil ratios of 0.5:1 to 15:1 and preferably 3:1 to 8:1, and a catalyst contact time of 0.1 to 50 seconds, and preferably 0.5 to 5 seconds, and most preferably about 0.75 to 2 seconds, and riser top temperatures of 900° to about 1050° F.

We claim:

1. An apparatus for the fluidized catalytic cracking of a heavy hydrocarbon feed comprising:
- a reactor vessel;
- a riser reactor, having a base section and an upper section;
- an inlet in a base of the riser for a heavy feed;
- an inlet in the base of the riser for a source of regenerated catalytic cracking catalyst;
- an outlet in the upper section of the riser for discharging catalytically cracked products and spent catalyst into said reactor vessel;
- a catalyst disengaging means within the reactor vessel for separation of cracked products from spent catalyst;
- a spent catalyst stripper means in a base portion of said reactor vessel contiguous with and beneath said disengaging means and having a spent catalyst inlet in an upper portion thereof, a stripped catalyst outlet in a lower portion thereof, and a stripping gas inlet in said lower portion thereof;
- a vertical stripper standpipe beneath the spent catalyst stripper means having an inlet connective with the stripped catalyst outlet and a standpipe catalyst outlet in a lower portion thereof;
- a regenerator vessel, a coke combustor vessel, at least part of which is within a lower region of said regenerator vessel, having
  - an inlet in a lower section for stripped catalyst from the stripper standpipe catalyst outlet;
  - an inlet in the lower section for an oxygen containing regeneration gas;
  - an outlet in an upper section for catalyst and flue gas; and the regenerator vessel having walls and receiving a catalyst and flue gas discharged from said coke combustor and having:

an inlet in a lower section for an oxygen containing regeneration gas;

an outlet in the lower section for recycle of regenerated catalyst to the base of the riser reactor; and an outlet for flue gas.

2. The apparatus of claim 1 wherein said coke combustor vessel comprises a vertical cylinder which is sealed at the base and open at the top.

3. The apparatus of claim 1 wherein said coke combustor vessel comprises a vertical cylinder which is sealed at the base, and the top of which is covered by a deflector cap means for discharging catalyst and flue gas from said coke combustor down to a lower portion of said regenerator vessel.

4. The apparatus of claim 3 wherein said regenerator vessel comprises an additional annular regeneration means having a base and defined on the sides thereof by a generally vertical cylinder and by the walls of the regenerator vessel, said annular catalyst regeneration means being in open fluid communication at the base thereof with said base of said regenerator vessel, and having a combustion air inlet means at the base thereof.

5. The apparatus of claim 1 comprising a heat exchange means connective with at least one of the regenerator vessel and the coke combustor vessel.

6. The apparatus of claim 1 wherein cyclones are provided in an upper region of the regenerator vessel for recovery of regenerated catalyst in said region, and have a means for adding at least a portion of the catalyst recovered from said cyclones to said coke combustor vessel.

7. The apparatus of claim 1 wherein a catalyst transfer means is provided for transfer of catalyst from said regenerator vessel to said coke combustor vessel.

* * * * *